US009127539B2

(12) United States Patent
Maier et al.

(10) Patent No.: US 9,127,539 B2
(45) Date of Patent: Sep. 8, 2015

(54) DOWNHOLE PACKER ASSEMBLY HAVING A SELECTIVE FLUID BYPASS AND METHOD FOR USE THEREOF

(71) Applicant: Halliburton Energy Services, Inc., Houston, TX (US)

(72) Inventors: Gary Allan Maier, Calgary (CA); Tanner Allan Rathwell, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 114 days.

(21) Appl. No.: 13/645,558

(22) Filed: Oct. 5, 2012

(65) Prior Publication Data

US 2013/0160996 A1 Jun. 27, 2013

(51) Int. Cl.

| | |
|---|---|
| ***E21B 33/12*** | (2006.01) |
| ***E21B 43/24*** | (2006.01) |
| ***E21B 47/06*** | (2012.01) |
| ***E21B 33/126*** | (2006.01) |

(52) U.S. Cl.

CPC ..... *E21B 43/24* (2013.01); *E21B 33/12* (2013.01); *E21B 33/126* (2013.01); *E21B 47/06* (2013.01)

(58) Field of Classification Search

CPC . E21B 43/24; E21B 43/2406; E21B 43/2408; E21B 33/12; E21B 36/00

USPC ..... 166/129, 133, 183, 184, 142, 305.1, 166/307, 308.1, 272.3, 146, 188

See application file for complete search history.

(56) References Cited

U.S. PATENT DOCUMENTS

| | | | | |
|---|---|---|---|---|
| 3,392,783 | A * | 7/1968 | Reed | 166/303 |
| 4,911,242 | A | 3/1990 | Hromas et al. | |
| 5,022,427 | A * | 6/1991 | Churchman et al. | 137/155 |
| 5,048,610 | A * | 9/1991 | Ross et al. | 166/372 |
| 5,318,117 | A | 6/1994 | Echol, III et al. | |
| 6,298,916 | B1 * | 10/2001 | Tibbles et al. | 166/278 |
| 7,770,637 | B2 * | 8/2010 | Phoi-montri et al. | 166/129 |
| 2007/0221372 | A1 | 9/2007 | Telfer | |
| 2009/0294137 | A1 | 12/2009 | Meijer | |

FOREIGN PATENT DOCUMENTS

WO 2011159283 12/2011

OTHER PUBLICATIONS

ISR & WO; PCT/US2011/058217; KIPO; Jul. 30, 2012.

* cited by examiner

*Primary Examiner* — Elizabeth Gitlin

(57) ABSTRACT

A downhole packer assembly for steam injection and casing pressure testing. The downhole packer assembly includes a housing assembly having intake and discharge ports. A seal assembly is positioned around the housing assembly between the intake and discharge ports and is operable to provide a fluid seal with a casing string. A mandrel is positioned within the housing assembly forming a micro annulus therewith and providing an internal pathway for fluid production therethrough. A valve assembly is disposed between the housing assembly and the mandrel and is operable between closed and open positions by a piston assembly such that the intake and discharge ports and the micro annulus provide a bypass passageway for steam injection around the seal assembly when the valve assembly is open and the seal assembly provides a downhole surface for pressure testing of the casing string uphole thereof when the valve assembly is closed.

12 Claims, 6 Drawing Sheets

DOWNHOLE PACKER ASSEMBLY HAVING A SELECTIVE FLUID BYPASS AND METHOD FOR USE THEREOF

CROSS-REFERENCE TO RELATED APPLICATIONS

This application claims the benefit under 35 U.S.C. §119 of the filing date of International Application No. PCT/US2011/58217, filed Oct. 28, 2011. The entire disclosure of this prior application is incorporated herein by this reference.

TECHNICAL FIELD OF THE INVENTION

This invention relates, in general, to equipment utilized in conjunction with operations performed in subterranean wells and, in particular, to a downhole packer assembly having a selective fluid bypass and method for use thereof.

BACKGROUND OF THE INVENTION

During the production of heavy oil, oil with high viscosity and high specific gravity, it is sometimes desirable to inject a recovery enhancement fluid into the reservoir to improve oil mobility. One type of recovery enhancement fluid is steam that may be injected using a cyclic steam injection process, which is commonly referred to as a "huff and puff" operation. In such a cyclic steam stimulation operation, a well is put through cycles of steam injection, soak and oil production. In the first stage, high temperature steam is injected into the reservoir. In the second stage, the well may be shut to allow for heat distribution in the reservoir to thin the oil. During the third stage, the thinned oil is produced into the well and may be pumped to the surface. This process may be repeated as required during the productive lifespan of the well.

It has been found that it may be desirable to periodically perform casing integrity testing on wells that utilize cyclic steam stimulation. In fact, some jurisdictions require casing integrity testing for such wells at predetermined intervals or frequencies. Typically, to perform the casing integrity testing, a workover rig is used to remove the production tubing and pumping equipment installed in the well and to run the testing string into the well. Thereafter, a fluid may be pumped into the well and pressurized to test the casing integrity. If the casing passes the test, the testing string may be removed and the production tubing and pumping equipment may be reinstalled. While casing integrity testing of wells performing cyclic steam stimulation operations is desirable, there are costs associated with the testing both from a financially standpoint as well as in terms of lost or delayed production.

Accordingly, a need has arisen for an improved tool system for cyclic steam injection. A need has also arisen for such an improved tool system that does not require a workover rig to performing casing integrity testing. Further, a need has arisen for such an improved tool system that does not require removal of the tool system prior to performing casing integrity testing.

SUMMARY OF THE INVENTION

The present invention disclosed herein is directed to a downhole packer assembly having a selective fluid bypass and method for use thereof that is operable for cyclic steam injection. The downhole packer assembly of the present invention does not require a workover rig for performing casing integrity testing. In addition, the downhole packer assembly of the present invention may remain in the well to aid in the casing integrity testing.

In one aspect, the present invention is directed to a downhole packer assembly for steam injection and casing pressure testing. The downhole packer assembly includes a housing assembly having intake and discharge ports. A seal assembly is positioned around the housing assembly between the intake and discharge ports. The seal assembly is operable to provide a fluid seal with a casing string. A mandrel is positioned within the housing assembly and forms a micro annulus therewith. The mandrel provides an internal pathway for fluid production therethrough. A valve assembly is disposed between the housing assembly and the mandrel. A piston assembly is also disposed between the housing assembly and the mandrel. The piston assembly is operable to shift the valve assembly between closed and open positions such that the intake and discharge ports and the micro annulus provide a bypass passageway for steam injection around the seal assembly when the valve assembly is in the open position and the seal assembly provides a downhole surface for pressure testing of the casing string uphole thereof when the valve assembly is in the closed position.

In one embodiment, the seal assembly may include a pair of oppositely disposed annular cup seals. In another embodiment, the intake and discharge ports may include a plurality of circumferentially disposed intake ports and a plurality of circumferentially disposed discharge ports. In a further embodiment, the valve assembly may include a sliding sleeve having at least one fluid port. The sliding sleeve is disposed between the housing assembly and the mandrel. A packing element is disposed between the siding sleeve and the housing assembly such that the at least one fluid port is part of the bypass passageway when the valve assembly is in the open position and the packing element prevents fluid flow through the at least one fluid port when the valve assembly is in the closed position.

In one embodiment, the piston assembly may include a spring, a tubular assembly disposed between the housing assembly and the mandrel, a first packing element disposed between the tubular assembly and the mandrel and a second packing element disposed between the tubular assembly and the housing assembly. In this embodiment, the tubular assembly may include a sliding sleeve and a packing mandrel operably associated with the sliding sleeve. In another embodiment, a hydraulic control line is in fluid communication with the piston assembly. The hydraulic control line is operable to apply hydraulic pressure to bias the piston assembly in a first direction, urging the valve assembly to the open position, which is in opposition to a biasing force of the spring in a second direction, urging the valve assembly to the closed position.

In another aspect, the present invention is directed to a method for steam injection and casing pressure testing in a wellbore. The method includes establishing a fluid seal between a downhole packer assembly and a casing string in the wellbore; opening a bypass passageway through the downhole packer assembly around the fluid seal; injecting steam into an annulus uphole of the downhole packer assembly; routing the steam through the bypass passageway and into an annulus downhole of the downhole packer assembly; closing the bypass passageway through the downhole packer assembly; and pressurizing fluid against the fluid seal to pressure test the casing string uphole of the downhole packer assembly.

The method may also include engaging opposing annular cup seals with the casing string, applying hydraulic pressure to shift a piston assembly and open a valve assembly, routing the steam through intake and discharge ports and a micro annulus of the downhole packer assembly, releasing hydraulic pressure and applying a spring force to shift a piston assembly and close a valve assembly, filling the annulus uphole of the downhole packer assembly with a liquid, soaking a reservoir formation with the steam or producing reservoir fluid through the downhole packer assembly.

In a further aspect, the present invention is directed to a method for steam injection and casing pressure testing in a wellbore. The method includes (a) establishing a fluid seal between a downhole packer assembly and a casing string in the wellbore; (b) opening a bypass passageway through the downhole packer assembly around the fluid seal; (c) injecting steam into an annulus uphole of the downhole packer assembly; (d) routing the steam through the bypass passageway and into an annulus downhole of the downhole packer assembly; (e) closing the bypass passageway through the downhole packer assembly; (f) soaking a reservoir formation with the steam; (g) producing reservoir fluid through the downhole packer assembly; (h) repeating steps (b)-(g); and (i) pressurizing fluid against the fluid seal to pressure test the casing string uphole of the downhole packer assembly.

In yet another aspect, the present invention is directed to a method for steam injection in a wellbore. The method includes establishing a fluid seal between a downhole packer assembly and a casing string in the wellbore; opening a bypass passageway through the downhole packer assembly around the fluid seal; injecting steam into an annulus uphole of the downhole packer assembly; routing the steam through the bypass passageway and into an annulus downhole of the downhole packer assembly; closing the bypass passageway through the downhole packer assembly; and preventing return flow of steam from the annulus downhole of the downhole packer assembly through the bypass passageway into the annulus uphole of the downhole packer assembly.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
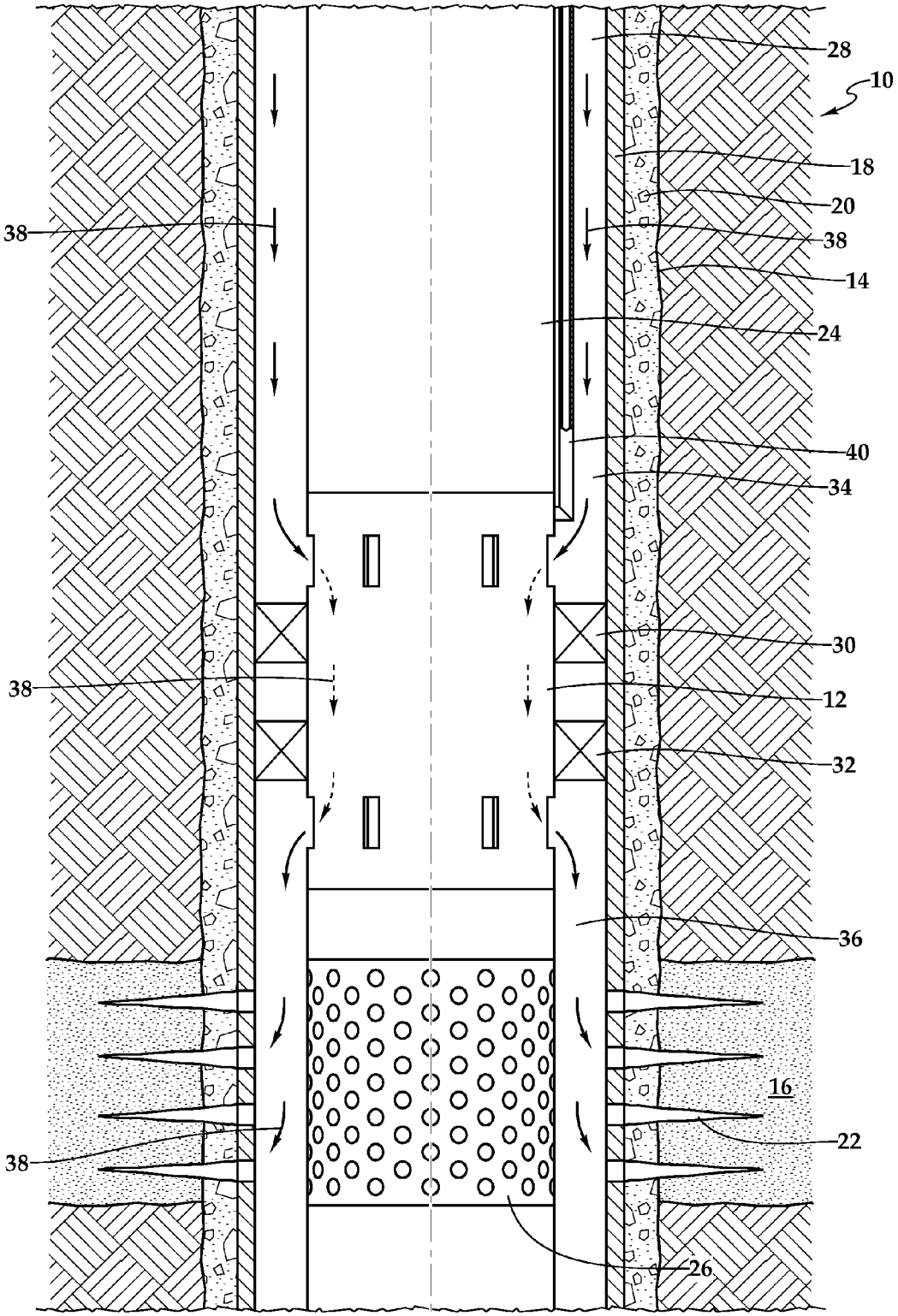
FIG. 1 is a schematic illustration of a well system including a downhole packer assembly according to an embodiment of the present invention.
Figure 3A:
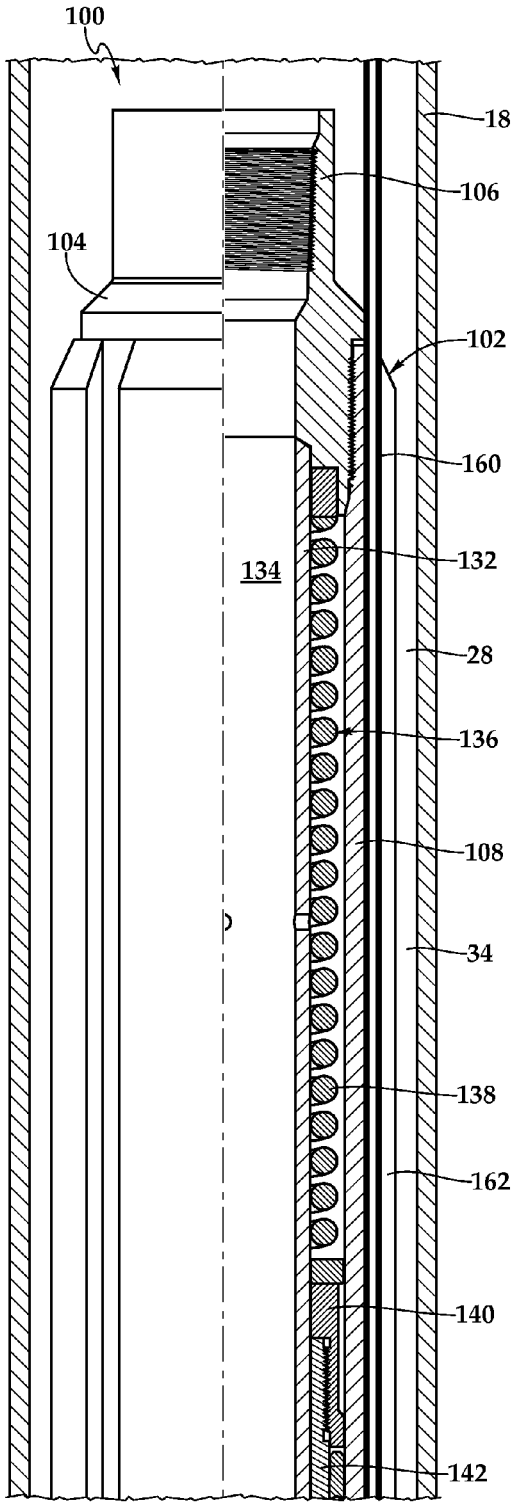
FIGS. 3A-E are quarter sectional views of successive axial sections of a downhole packer assembly in an open position according to an embodiment of the present invention.
Figure 3B:
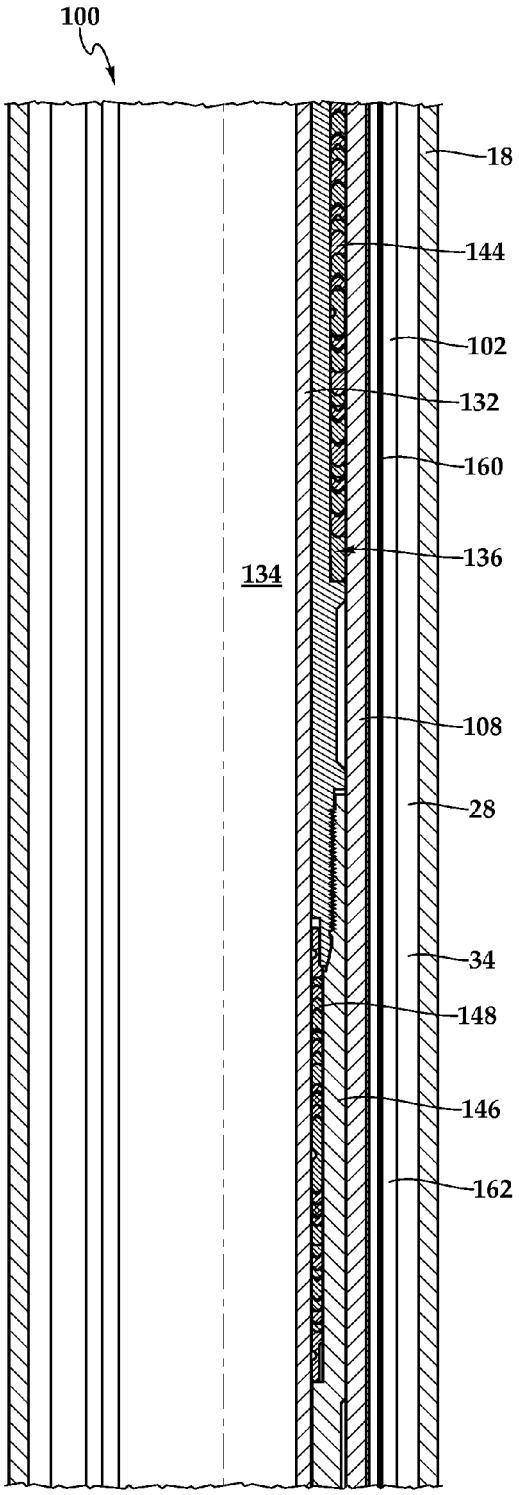

Referring initially to FIG. 1, therein is depicted a well system including a downhole packer assembly embodying principles of the present invention that is schematically illustrated and generally designated 10. In the illustrated embodiment, downhole packer assembly 12 is positioned in a wellbore 14 that extends through the various earth strata including a hydrocarbon bearing subterranean formation 16. Wellbore 14 has casing string 18 secured therein by cement 20. Communication between the interior of casing string 18 and formation 16 may be established through a slotted liner or, as illustrated, via a plurality of perforations 22.

Positioned within wellbore 14 and extending from the surface is a tubing string 24. Tubing string 24 provides a conduit for formation fluids to travel from formation 16 to the surface. Formation fluids may enter tubing string 24 at its lower end (not pictured) or through a ported subassembly 26, as illustrated, that may include sand control and/or flow control capabilities. Tubing string 24 also includes downhole packer assembly 12 of the present invention. An annular space 28 is formed between tubing string 24 and casing string 18. As explained in greater detail below, downhole packer assembly 12 is operable to provide a fluid seal between tubing string 24 and casing string 18 across annular space 28 with seal assemblies 30, 32. In addition, downhole packer assembly 12 has selective fluid bypass capabilities that enable fluid to travel within downhole packer assembly 12 around seal assemblies 30, 32 such that fluid may travel from upper annulus section 34 above downhole packer assembly 12 to lower annulus section 36 below downhole packer assembly 12, as indicated by arrows 38. For example, arrows 38 may represent steam that is being injected into formation 16 during a cyclic steam stimulation operation.

As described below, the flow of fluid from upper annulus section 34 to lower annulus section 36 through downhole packer assembly 12 may be controlled using one or more valves within downhole packer assembly 12. The valves may be moved between closed and open positions to prevent or allow fluid flow using fluid pressure from the surface via hydraulic conduit 40. Preferably, the valves have fail safe operations wherein the hydraulic fluid is used to open the valves and a loss of hydraulic pressure results in the valves closing. Even though hydraulically operated valves have been described, it should be understood by those skilled in the art other means of controlling flow through downhole packer assembly 12 may be used including, but not limited to, pneumatic or gas powered operations, wired or wireless communication used to actuate the valves, or mechanical intervention via wireline, slickline, coiled tubing or other conveyance.

Continuing with the example above wherein downhole packer assembly 12 is being used in a well during a cyclic steam stimulation operation, downhole packer assembly 12 provides a seal between tubing string 24 and casing string 18 and separates annular space 28 into upper annulus section 34 and lower annulus section 36. Hydraulic pressure within hydraulic conduit 40 is used to open the valves with downhole packer assembly 12 creating a bypass passageway therethrough. Thereafter, steam may be injected into formation 16 as indicated by arrows 38. When the steam injection phase of the cyclic steam stimulation operation is complete, the hydraulic pressure can be released to close the valves with downhole packer assembly 12, thereby shutting off the bypass passageway therethrough. After the soaking phase of the cyclic steam stimulation operation, flow control components (not pictured) of the well system may be opened to allow reservoir fluids to be produced into the well. Pumps or other well equipment may be used to aid in lifting the reservoir fluids to the surface if desired. The phases of the cyclic steam stimulation operation may be repeated wherein the valves of downhole packer assembly 12 are opened and closed as necessary.

Importantly, if integrity testing of casing string 18 is desired, downhole packer assembly 12 enables such testing without the need for a workover rig as downhole packer assembly 12 may be left in the well to aid in the testing procedures. As stated above, since downhole packer assembly 12 provides a seal between tubing string 24 and casing string 18 and separates annular space 28 into upper annulus section 34 and lower annulus section 36, the integrity of casing string 18 can be tested against seals 30, 32 of downhole packer assembly 12. Specifically, with the hydraulic pressure released and the valves closed within downhole packer assembly 12, there is no fluid path in annular space 28 between upper annulus section 34 and lower annulus section 36. As such, fluid in upper annulus section 34 may be pressurized to perform integrity testing of casing string 18.

Even though FIG. 1 depicts the present invention in a vertical wellbore, it should be understood by those skilled in the art that the present invention is equally well suited for use in wellbores having other directional configurations including horizontal wellbores, deviated wellbores, slanted wellbores, lateral wellbores and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Referring to FIGS. 2A-E and 3A-E, an illustrative embodiment of a downhole packer assembly that is generally designated 100 is depicted in a closed position and an open position, respectively. Downhole packer assembly 100 has a housing assembly 102 that includes a plurality of housing sections that are threadably and sealingly coupled to one another. In the illustrated embodiment, housing assembly 102 includes an upper adaptor 104 having a tubing socket 106 into which the pin end of a tubular member (not shown) of a tubing string or other downhole tool may be inserted and coupled thereto. Housing assembly 102 also includes an upper housing segment 108 and a lower housing segment 110. Housing assembly 102 further includes a sealing support housing segment 112 and a lower adaptor 114 having a tubing pin 116 that is insertable into a tubing socket of a tubular member (not shown) of the tubing string or other downhole tool. Even though a particular housing design has be depicted and described, those skilled in the art with understand that the housing of the present invention could have other numbers of housing elements in alternate configurations and having alternate connection means without departing from the principles of the present invention.

Positioned around sealing support housing segment 112 is a seal assembly 118. As explained above, seal assembly 118 provides a fluid seal between downhole packer assembly 100 and casing string 18. In the illustrated embodiment, seal assembly 118 includes an upper annular cup seal 120 and a lower annular cup seal 122 that are oppositely disposed from one another. Annular cups 120, 122 may be formed from any material capable of providing a fluid seal with casing string 18. For example, annular cups 120, 122 may be formed from a polymer including thermoplastics such as glass-filled Teflon including 40% GFT or elastomers such as ethylene propylene diene monomer (EPDM). Upper annular cup seal 120 is supported by a backup shoe 124 and lower annular cup seal 122 is supported a backup shoe 126.

Housing assembly 102 includes multiple ports that allow fluid to travel into and out of downhole packer assembly 100. In the illustrated embodiment, lower housing segment 110 includes multiple intake ports 128 that are spaced around the circumference of lower housing segment 110 and are uphole of seal assembly 118. Lower adaptor 114 includes multiple discharge ports 130 spaced around the circumference of lower adaptor 114 and downhole of seal assembly 118. As explained below, intake ports 128 and discharge ports 130 are part of the selective fluid bypass of downhole packer assembly 100. Even though a particular number of intake ports and discharge ports have been depicted in particular housing segments, it will be appreciated that any number of intake ports and/or discharge ports may be included and may be located in any of the housing segments as long as sufficient fluid flow is allowed and selective fluid bypass is provided.

Positioned within housing assembly 102 and extending between upper adaptor 104 and lower adaptor 114 is an inner mandrel 132. Inner mandrel 132 provides a fluid pathway 134 through downhole packer assembly 100 which is in fluid communication with the inside of the tubing string for the production of reservoir fluids therethrough. Positioned between inner mandrel 132 and housing assembly 102 is a piston assembly 136. Piston assembly 136 includes a spiral wound compression spring 138, packing retainer 140, packing mandrel 142, packing element 144, sliding sleeve 146 and packing element 148.

Figure 2A:
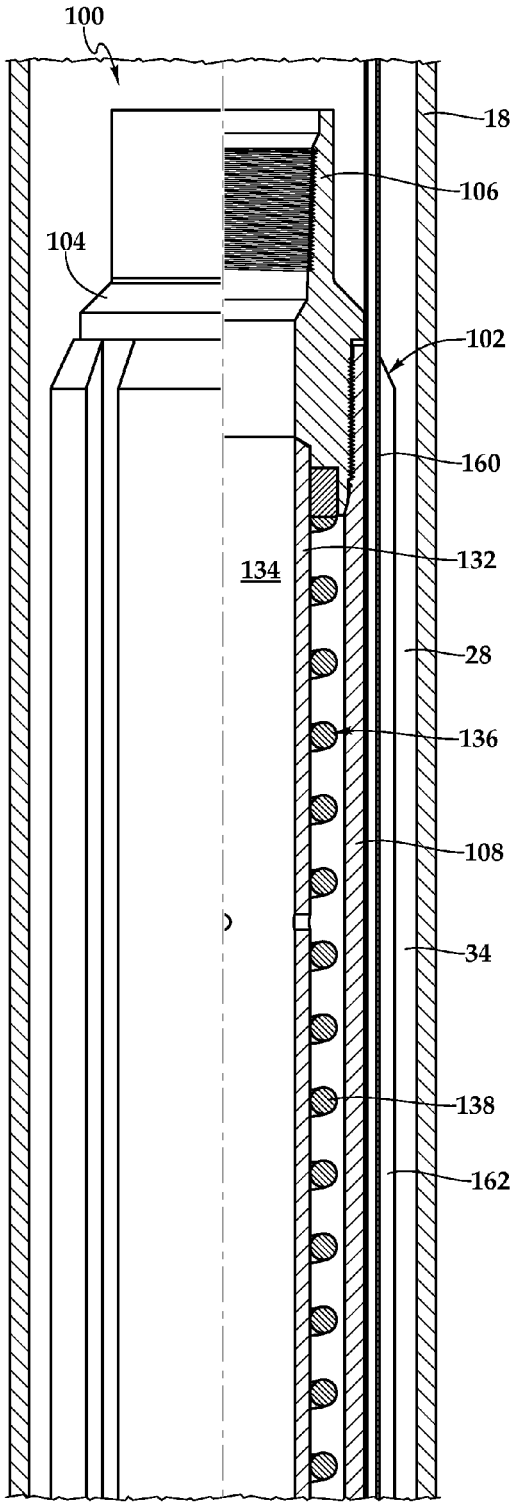
FIGS. 2A-E are quarter sectional views of successive axial sections of a downhole packer assembly in a closed position according to an embodiment of the present invention.
Figure 2B:
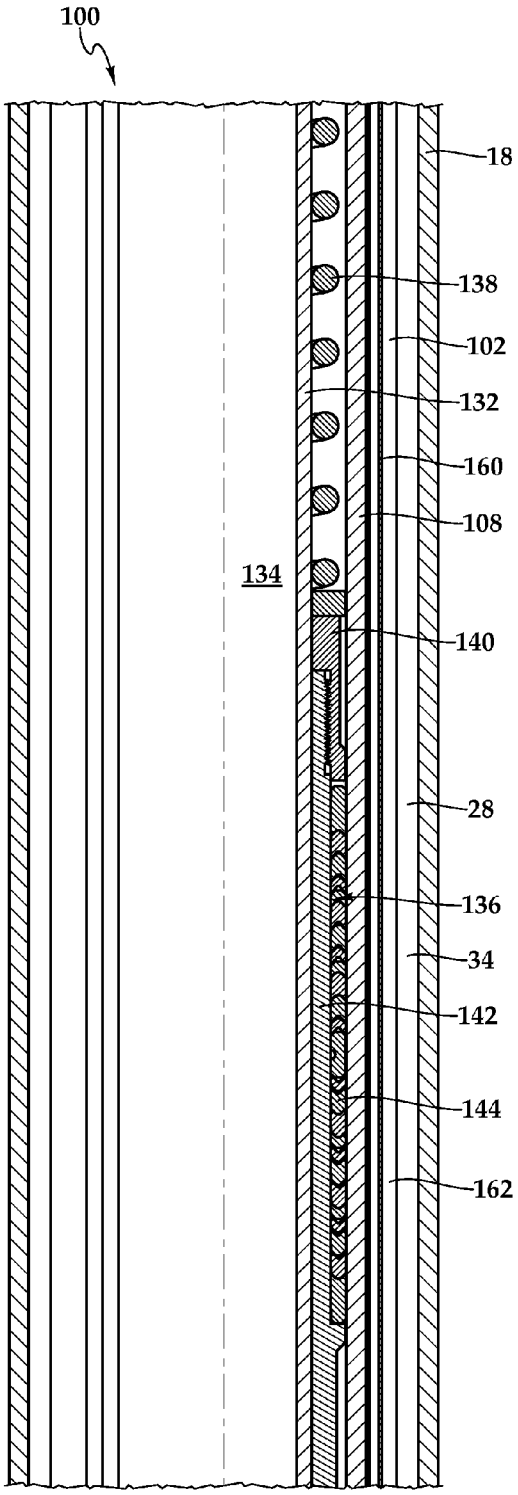
Figure 2C:
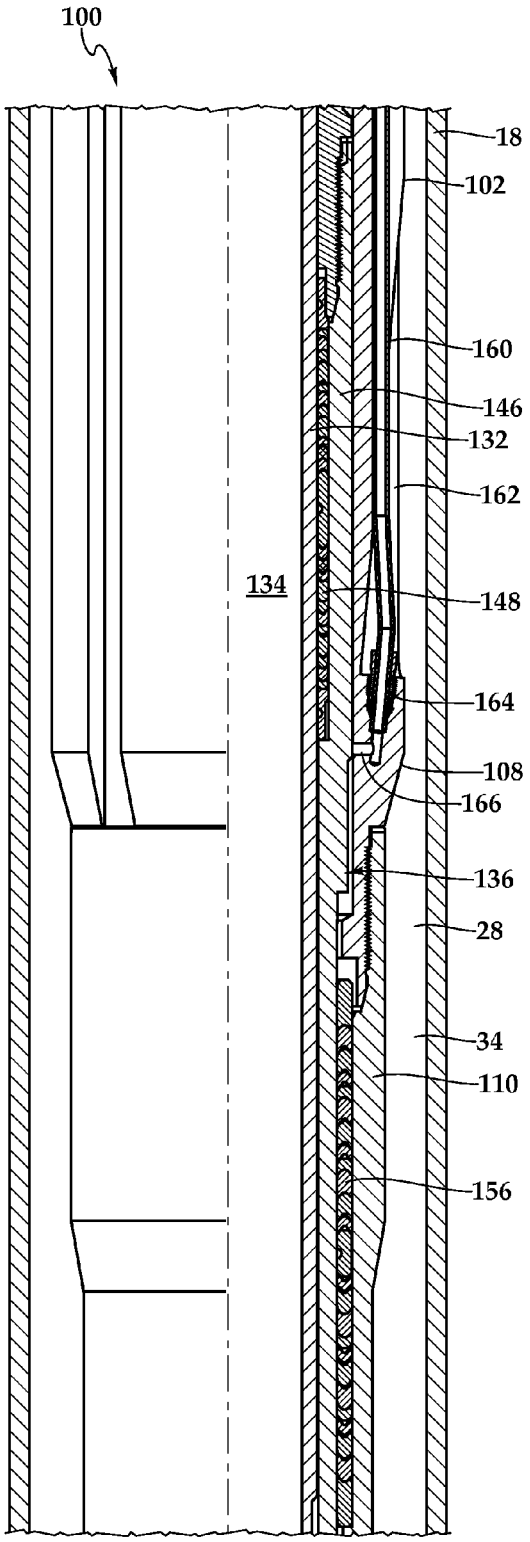
Figure 3C:
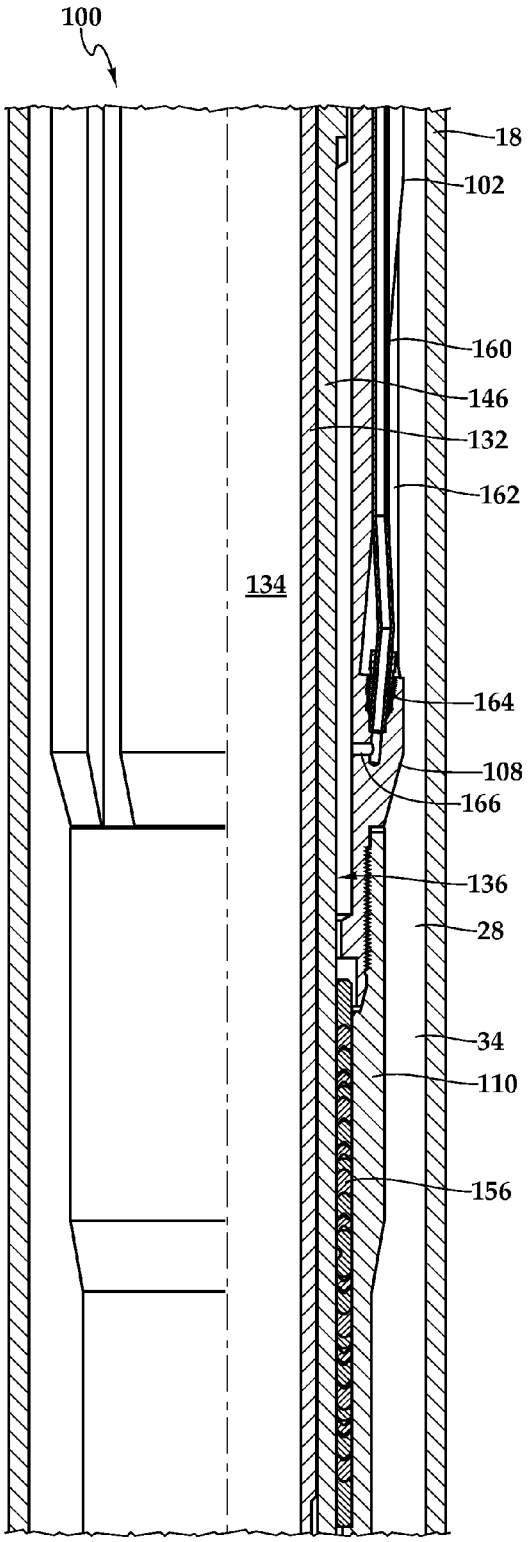
Figure 2D:
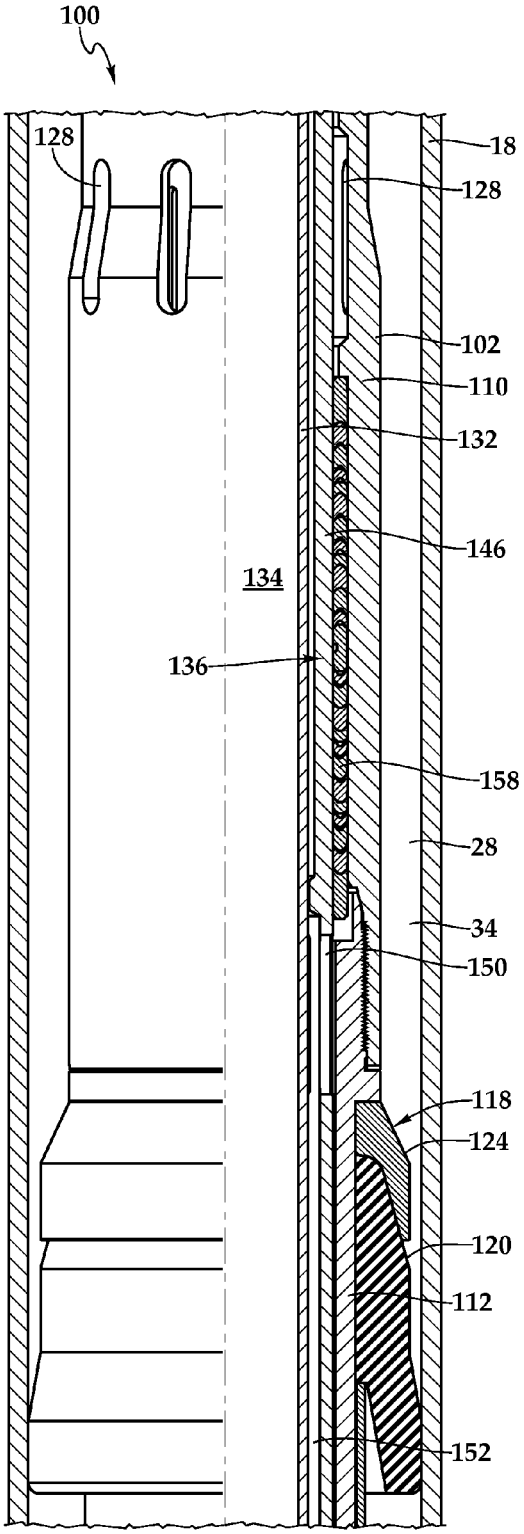
Figure 3D:
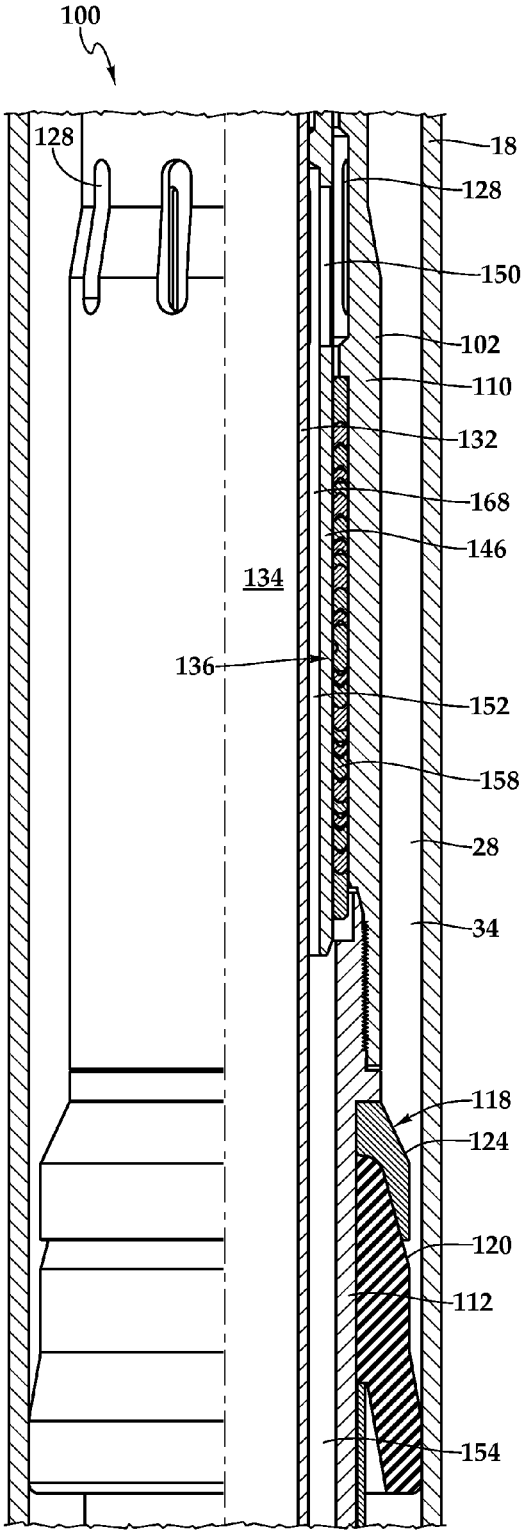
Figure 2E:
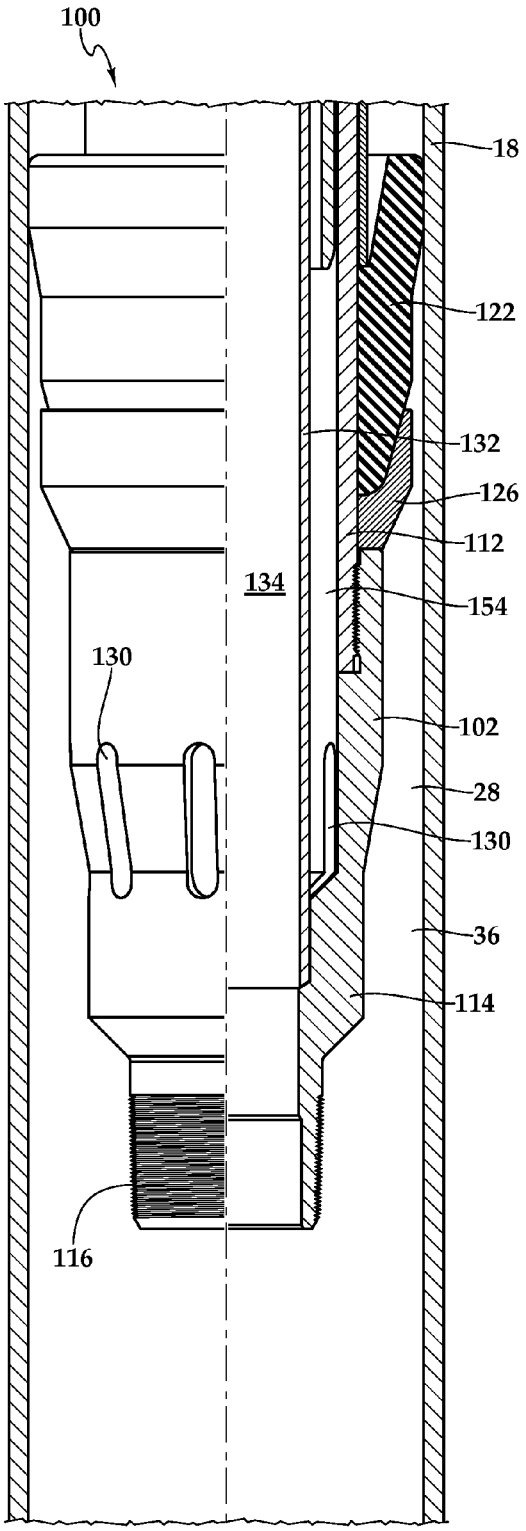
Figure 3E:
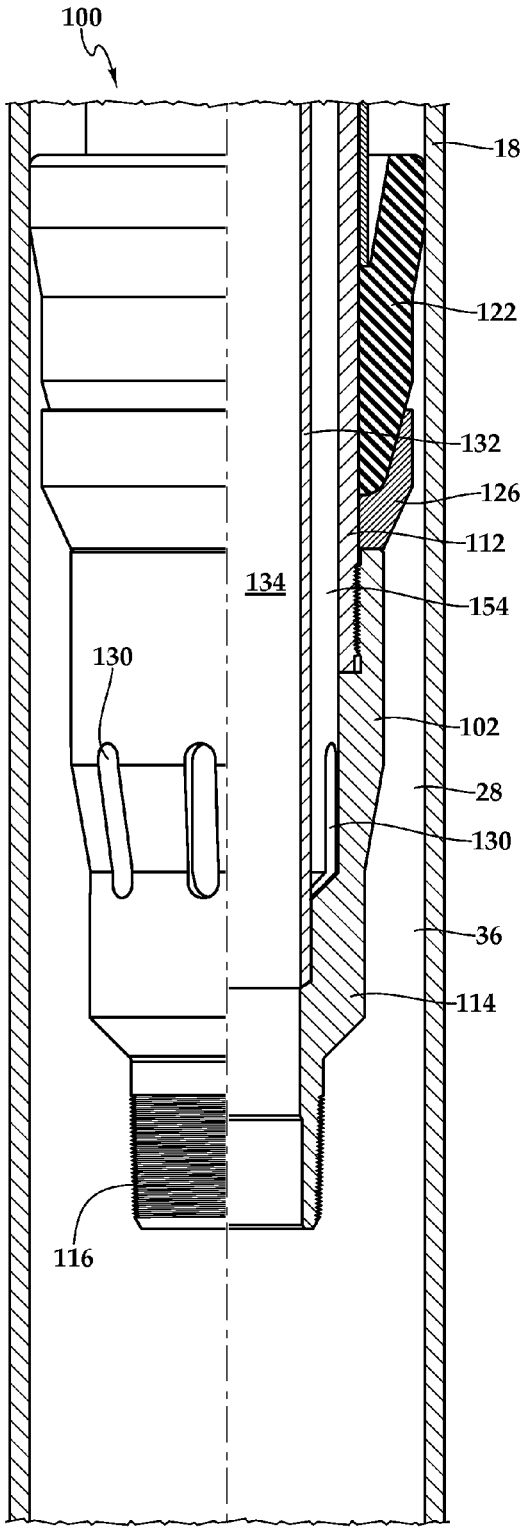

In the illustrated embodiment, spring 138 is positioned between a lower shoulder of upper adaptor 104 and an upper shoulder of packing retainer 140 to downwardly bias the other elements of piston assembly 136. Together, packing retainer 140 and packing mandrel 142 support packing element 144 such that a fluid seal is created between piston assembly 136 and an interior surface of upper housing segment 108. Similarly, packing mandrel 142 and sliding sleeve 146 support packing element 148 such that a fluid seal is created between piston assembly 136 and an exterior surface of inner mandrel 132. As best seen in FIGS. 2D and 3D, sliding sleeve 146 includes one or more ports 150 that are part of the selective fluid bypass of downhole packer assembly 100. In addition, the lower portion of sliding sleeve 148 forms a micro annulus 152 with inner mandrel 132, which is also part of the selective fluid bypass of downhole packer assembly 100. A micro annulus 154 is also formed between inner mandrel 132 and a lower portion of sealing support housing segment 112 and lower adaptor 114.

Positioned between sliding sleeve 146 and lower housing segment 110 is a pair of packing elements 156, 158 that are respectively positioned above and below intake ports 128. The various packing elements 144, 148, 156, 158 include multiple sealing element and backup elements as are known to those skilled in the art. In one embodiment, the backup elements may be formed from a polymer such as a thermoplastic including, but not limited to, polyetheretherketone (PEEK), an elastomer including, but not limited to, ethylene propylene diene monomer (EPDM) or a fluoropolymer including, but not limited to, polytetrafluoroethylene (PTFE). Preferably, the backup elements may be formed from a flexible graphite including Grafoil® and Grafoil® composites. The sealing elements may be formed from an elastomer such as a synthetic rubber, a butadiene rubber (BR), a nitrile rubber (NBR), a fluoroelastomer (FKM), a perfluoroelastomer (FFKM) or other thermoset material. Preferably, the sealing elements may be formed from an ethylene propylene diene monomer (EPDM).

In the illustrated embodiment, downhole packer assembly 100 is hydraulically actuated. Specifically, a control line 160 that extends from the surface is disposed within a channel 162 of upper housing segment 108. Control line 160 connects to downhole packer assembly 100 at a hydraulic coupling 164. Hydraulic fluid may be pressurized in control line 160 and enters downhole packer assembly 100 at hydraulic port 166, as best seen in FIGS. 2C and 2D. When energized, the hydraulic fluid or other operation fluid acts on a lower surface of sliding sleeve 146. When the force generated by the hydraulic fluid is sufficient to overcome the spring force of spring 138, piston assembly 136 shifts upwardly relative to housing assembly 102, as best seen in FIGS. 3A-3E. When the hydraulic pressure is released, the spring force shifts piston assembly 136 downwardly relative to housing assembly 102, as best seen in FIGS. 2A-2E.

In operation, downhole packer assembly 100 may be deployed into a well as part of a completion on a tubing string as described above with reference to FIG. 1. When downhole packer assembly 100 reached its target location, a fluid seal may be established between downhole packer assembly 100 and casing string 18 using seal assembly 118. This fluid seal divides annular space 28 into upper annulus section 34 above seal assembly 118 and lower annulus section 36 below seal assembly 118. If it is desired to perform a cyclical steam stimulation operation, for example, hydraulic fluid may now be applied through control line 160. The hydraulic fluid acts on a lower surface of sliding sleeve 146. When the hydraulic force exceeds the biasing force of spring 138, piston assembly 136 shifts upwardly from the closed position depicted in FIGS. 2A-2E to the open position depicted in FIGS. 3A-3E. In particular, in the open position, ports 150 of sliding sleeve 146 are positioned between packing elements 156, 158 and, as such, ports 150 of sliding sleeve 146 and packing element 158 operate as a valve and may be referred to as a valve assembly. In this configuration, a bypass passageway 168 is created through downhole packer assembly 100. In the illustrated embodiment, the bypass passageway includes intake ports 128, ports 150 of sliding sleeve 146, micro annulus 152, micro annulus 154 and discharge ports 130. As long as the hydraulic pressure is maintained, bypass passageway 168 of downhole packer assembly 100 remains open.

The steam injection phase of the cyclic steam stimulation operation may now be performed wherein the steam is injected into annular space 28 at the surface. The steam travels down the well into upper annulus section 34 and into downhole packer assembly 100 at intake ports 128. The steam then travels in bypass passageway 168 bypassing seal assembly 118. The steam reenters annular space 30 via discharge ports 130 into lower annulus section 36. Thereafter, the steam enters one or more reservoir formations such as formation 16 described above. When the steam injection phase of the cyclic steam stimulation operation is complete, the hydraulic pressure can be released such that the biasing force of spring 138 downwardly shifts piston assembly 136 from the open position depicted in FIGS. 3A-3E to the closed position depicted in FIGS. 2A-2E. In particular, in the closed position, ports 150 of sliding sleeve are no longer positioned between packing elements 156, 158. Instead, ports 150 are below packing elements 158. In this configuration, bypass passageway 168 is disabled as there is no fluid communication between intake ports 128 and ports 150. As such, the high pressure, high temperature steam is trapped below seal assembly 118 to enable a soaking phase of the cyclic steam stimulation operation, if desired. In this configuration, downhole packer assembly 100 may also be referred to as an annular subsurface safety valve, as return flow of steam from lower annulus section 36 through bypass passageway 168 into upper annulus section 34 is prevented and direct flow of steam from lower annulus section 36 into upper annulus section 34 is prevented by seal assembly 118.

After the soaking phase of the cyclic steam stimulation operation, flow control components of the well system may be opened to allow reservoir fluids to be produced into the well. Pumps or other well equipment may be used to aid in lifting the reservoir fluids to the surface, if desired. The phases of the cyclic steam stimulation operation may be repeated wherein application and removal of the hydraulic fluid force may be used to open and close bypass passageway 168 as necessary. Alternatively, if it is determined that an extended soaking phase is not required, when the steam injection phase of the cyclic steam stimulation operation is complete, the hydraulic pressure may be maintained to keep piston assembly 136 in the open position depicted in FIGS. 3A-3E and flow control components of the well system may be opened to allow reservoir fluids to be produced into the well. Pumps or other well equipment may be used to aid in lifting the reservoir fluids to the surface, if desired.

If it is desired to perform an integrity test of casing string 18, downhole packer assembly 100 enables such testing without the need for a workover rig as downhole packer assembly 100 may be left in the well to aid in the testing procedures. Specifically, when downhole packer assembly 100 is in the closed position, wherein bypass passageway 168 is disabled and there is no fluid communication between intake ports 128 and ports 150, seal assembly 118 provides a fluid seal that separates annular space 28 into upper annulus section 34 and lower annulus section 36. In this configuration, a desired fluid, such as a liquid, may be used to fill annular space 28 above seal assembly 118. With seal assembly 118 providing a downhole surface, the fluid in annular space 28 can be pressurized such that pressure testing of casing 18 uphole thereof can be performed. After such pressure testing, the fluid may be removed and the cyclic steam stimulation operation can recommence.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method for steam injection and casing pressure testing in a wellbore, comprising:

establishing a fluid seal between a downhole packer assembly and a casing string in the wellbore;

opening a bypass passageway through the downhole packer assembly around the fluid seal by increasing hydraulic pressure in a control line and shifting a piston assembly against the bias force of a spring to establish fluid communication between intake and discharge ports of the downhole packer assembly through at least one port of a sliding sleeve of the piston assembly;

injecting steam into an annulus uphole of the downhole packer assembly;

routing the steam through the bypass passageway and into an annulus downhole of the downhole packer assembly while maintaining the increased hydraulic pressure in the control line;

closing the bypass passageway through the downhole packer assembly by decreasing hydraulic pressure in the control line and shifting the piston assembly responsive to the bias force of the spring to end the fluid communication between the intake and discharge ports of the downhole packer assembly through the at least one port of the sliding sleeve of the piston assembly; and pressurizing fluid against the fluid seal in the annulus uphole of the downhole packer assembly to pressure test the casing string uphole of the downhole packer assembly.

2. The method as recited in claim 1 wherein establishing a fluid seal between the downhole packer assembly and the casing string in the wellbore further comprises engaging opposing annular cup seals with the casing string.

3. The method as recited in claim 1 wherein routing the steam through the bypass passageway and into the annulus downhole of the downhole packer assembly further comprises routing the steam through the intake and discharge ports and a micro annulus of the downhole packer assembly.

4. The method as recited in claim 1 wherein pressurizing fluid against the fluid seal to pressure test the casing string uphole of the downhole packer assembly further comprises filling the annulus uphole of the downhole packer assembly with a liquid.

5. The method as recited in claim 1 further comprising soaking a reservoir formation with the steam.

6. The method as recited in claim 1 further comprising producing reservoir fluid through the downhole packer assembly.

7. A method for steam injection and casing pressure testing in a wellbore, comprising:

a. establishing a fluid seal between a downhole packer assembly and a casing string in the wellbore;

b. opening a bypass passageway through the downhole packer assembly around the fluid seal by increasing hydraulic pressure in a control line and shifting a piston assembly against the bias force of a spring to establish fluid communication between intake and discharge ports of the downhole packer assembly through at least one port of a sliding sleeve of the piston assembly;

c. injecting steam into an annulus uphole of the downhole packer assembly;

d. routing the steam through the bypass passageway and into an annulus downhole of the downhole packer assembly while maintaining the increased hydraulic pressure in the control line;

e. closing the bypass passageway through the downhole packer assembly by decreasing hydraulic pressure in the control line and shifting the piston assembly responsive to the bias force of the spring to end the fluid communication between the intake and discharge ports of the downhole packer assembly through the at least one port of the sliding sleeve of the piston assembly;

f. soaking a reservoir formation with the steam;

g. producing reservoir fluid through the downhole packer assembly;

h. repeating steps b-g; and i. pressurizing fluid against the fluid seal in the annulus uphole of the downhole packer assembly to pressure test the casing string uphole of the downhole packer assembly.

8. The method as recited in claim 7 wherein establishing a fluid seal between the downhole packer assembly and the casing string in the wellbore further comprises engaging opposing annular cup seals with the casing string.

9. The method as recited in claim 7 wherein routing the steam through the bypass passageway and into an annulus downhole of the downhole packer assembly further comprises routing the steam through the intake and discharge ports and a micro annulus of the downhole packer assembly.

10. The method as recited in claim 7 wherein pressurizing fluid against the fluid seal to pressure test the casing string uphole of the downhole packer assembly further comprises filling the annulus uphole of the downhole packer assembly with a liquid.

11. A method for steam injection in a wellbore, comprising:

establishing a fluid seal between a downhole packer assembly and a casing string in the wellbore;

opening a bypass passageway through the downhole packer assembly around the fluid seal by increasing hydraulic pressure in a control line and shifting a piston assembly against the bias force of a spring to establish fluid communication between intake and discharge ports of the downhole packer assembly through at least one port of a sliding sleeve of the piston assembly;

injecting steam into an annulus uphole of the downhole packer assembly;

routing the steam through the bypass passageway and into an annulus downhole of the downhole packer assembly while maintaining the increased hydraulic pressure in the control line;

closing the bypass passageway through the downhole packer assembly by decreasing hydraulic pressure in the control line and shifting the piston assembly responsive to the bias force of the spring to end the fluid communication between the intake and discharge ports of the downhole packer assembly through the at least one port of the sliding sleeve of the piston assembly; and preventing return flow of steam from the annulus downhole of the downhole packer assembly into the annulus uphole of the downhole packer assembly.

12. The method as recited in claim 11 wherein preventing return flow of steam from the annulus downhole of the downhole packer assembly into the annulus uphole of the downhole packer assembly further comprises engaging opposing annular cup seals with the casing string and blocking a micro annulus through the downhole packer assembly with a valve assembly.

* * * * *